United States Patent [19]

Blain

[11] Patent Number: 4,615,534

[45] Date of Patent: Oct. 7, 1986

[54] MOVABLE AND FOLDABLE WHEEL SUPPORT PARTICULARLY FOR RUBBER BOATS

[76] Inventor: René H. Blain, Les Glycines B3 24-30, rue du 11 novembre, Neuilly sur Marne, France

[21] Appl. No.: 673,369

[22] PCT Filed: Mar. 19, 1984

[86] PCT No.: PCT/FR84/00068

§ 371 Date: Nov. 20, 1984

§ 102(e) Date: Nov. 20, 1984

[87] PCT Pub. No.: WO84/03678

PCT Pub. Date: Sep. 27, 1984

[30] Foreign Application Priority Data

Mar. 22, 1983 [FR] France ..... 83 04669

[51] Int. Cl.[4] ..... B62B 1/04

[52] U.S. Cl. ..... 280/47.13 B; 280/43.17; 280/767; 403/107; 403/109

[58] Field of Search ..... 280/47.13 B, 43.17, 280/43.24, 414.2, 767, 47.14; 403/107, 109; 114/344

[56] References Cited

U.S. PATENT DOCUMENTS 3,210,783 10/1965 Petty ..... 114/344
4,303,254 12/1981 Swanson et al. ..... 280/43.2

FOREIGN PATENT DOCUMENTS 1546817 10/1968 France ..... 280/47.13 B
2442765 6/1980 France ..... 280/47.13 B

*Primary Examiner*—David M. Mitchell
*Assistant Examiner*—Eric Culbreth
*Attorney, Agent, or Firm*—Steele, Gould & Fried

[57] ABSTRACT

A foldable wheel support enables setting in operative position or retracting supporting wheels for boats even in high sea conditions, without disassembling or reassembling, and with space saving on the boat. The support has a first tube secured to the boat to which a second tube carrying the wheel is hinged such that the first and second tubes can be aligned. A third tube is inserted inside the first and second tubes, enabling folding or holding the first and second tubes in aligned position. A rope, and optionally a handle, enable folding and unfolding.

6 Claims, 19 Drawing Figures

FIG. 3
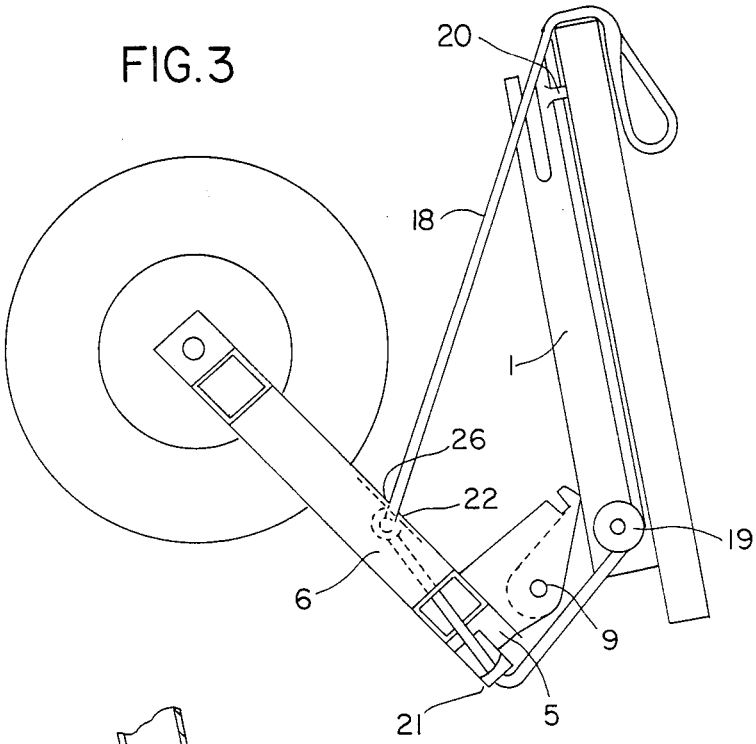
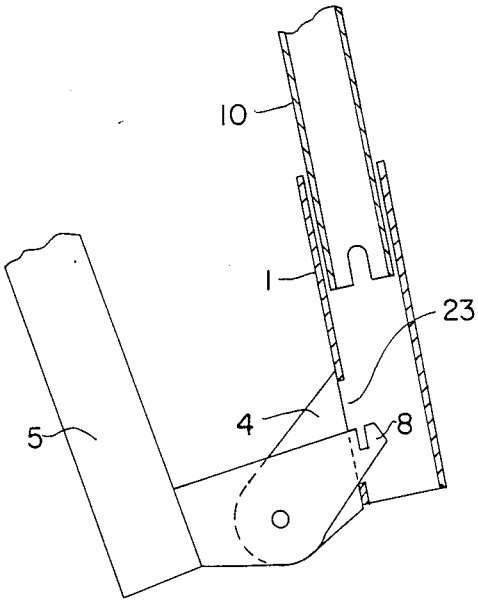
FIG. 4
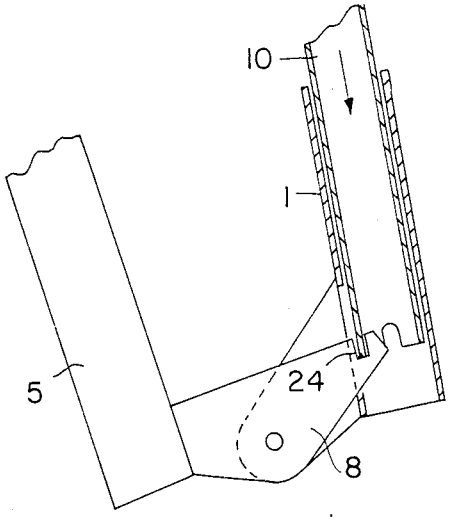
FIG. 5

10
33
31
30
3
29
32
1
2
28
8
5
6

10
32
31
33
3
29
8
2

10
33
31
32
3
29
2

10
34
35
1

FIG. 11
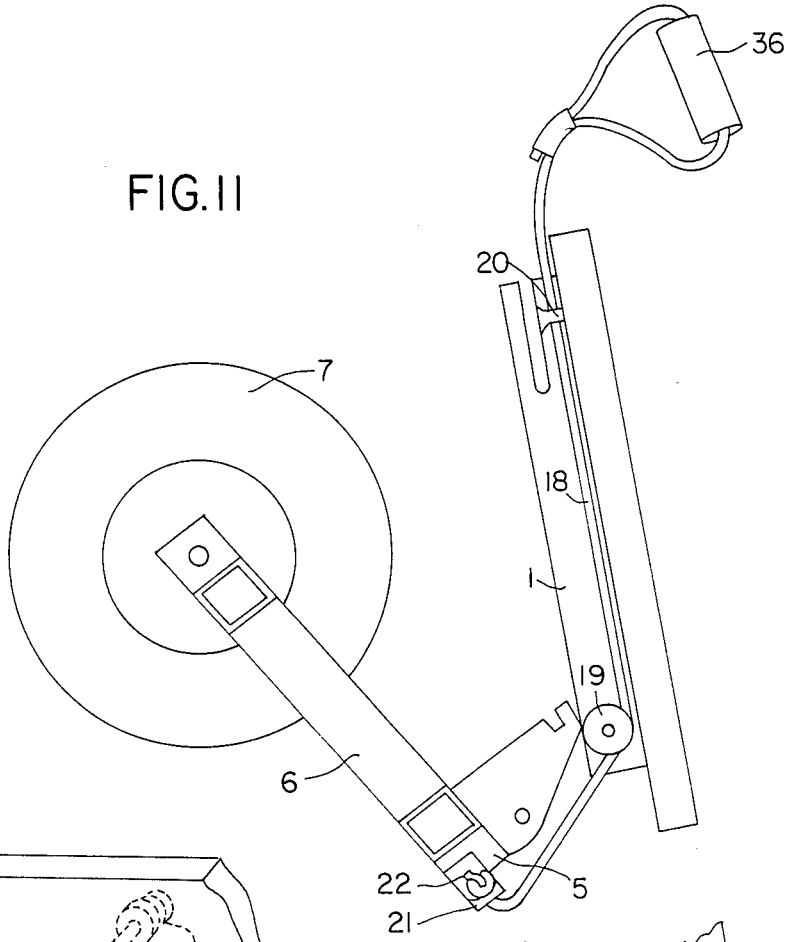
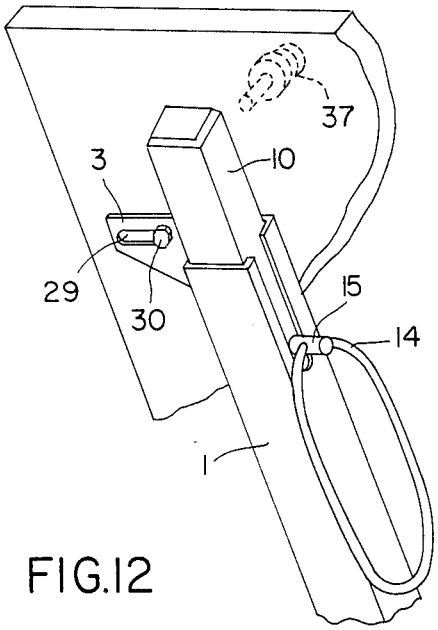
FIG. 12
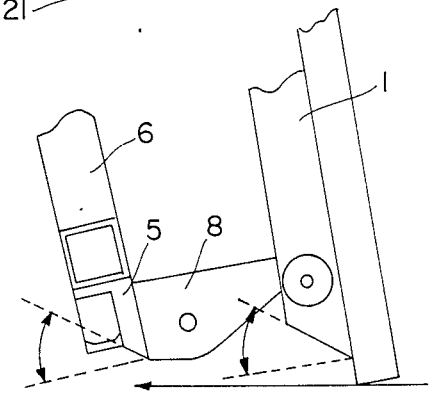
FIG. 13

FIG. 17
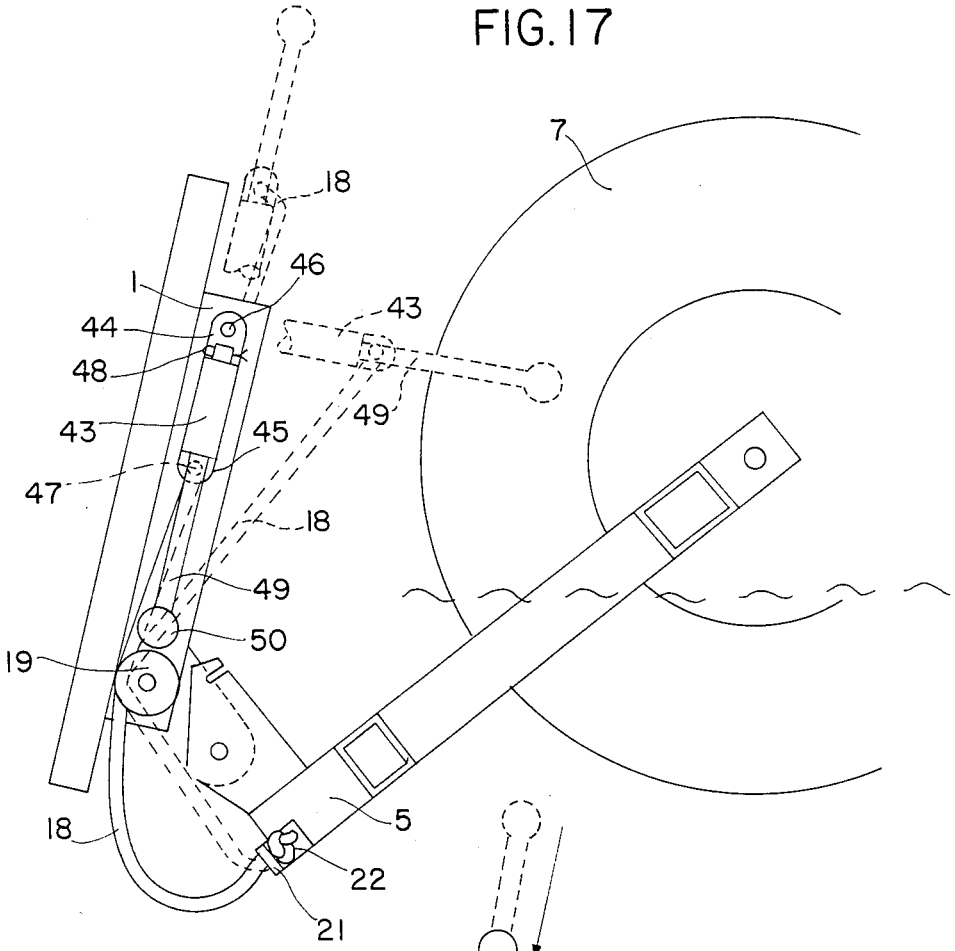
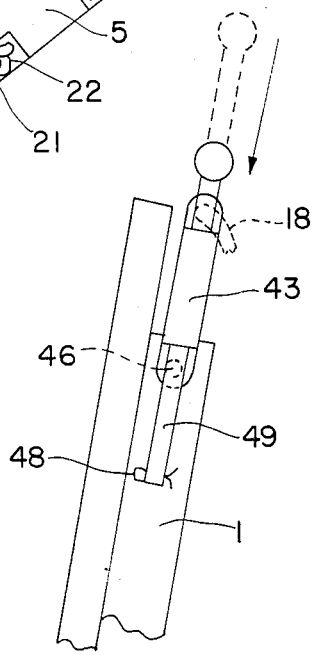
FIG. 18

MOVABLE AND FOLDABLE WHEEL SUPPORT PARTICULARLY FOR RUBBER BOATS

BACKGROUND OF THE INVENTION

The present invention relates to a removable foldable wheel support which, used in pairs and fixed to the rear of the boat, forms a device for putting the boat into water and hoisting it in. The device is especially useful for inflatable boats, but may be used for other purposes such as: transport of different sea craft and uses not related to sea craft.

Some known prior art removable wheel supports are removable rigid wheel supports in a single piece, which must be dismantled at sea and placed in the boat. Others are, hingedly fixed to the back board may be raised and fixed in an inoperative position, the supports being either substantially horizontal, the rearward wheel away from the back board, or vertical, the wheels being above the back board of the boat.

Others are telescopic, the wheel being raised and placed behind the back board by a movement both of horizontal rotation and of vertical translation.

These devices have certain disadvantages either because they comprise mechanical parts, rollers, and/or springs which are not readily compatible with sea water, or they must be dismantled at sea and placed in the boat where they take up space. The devices must be reassembled or handled for landing especially in the case of a heavy sea, wind or currents, or because mechanical elements project above the back board or take up space required for the big motors normally-mounted behind this board and form a hindrance for handling the boat.

Another disadvantage of some of these devices concerns positioning of the wheels in the operative position more particularly at sea before landing and for hauling in especially when the sea is high. Placing these wheels in the operative position is made difficult when inflatable tires are used, but such tires are, necessary because of their flexibility and, for transporting the boat onto the bank. However, immersion of the wheels comes up against the thrust of Archimedes and requires direct manual intervention forcing the buoyant tires down outside the boat.

This problem can only be solved by using wheels of a density greater than that of water, being heavy, hard and unsuitable for transport on land.

SUMMARY OF THE INVENTION

The wheel support of the invention avoids these disadvantages with prior wheels for boats.

Although it is removable, the support may remain fixed to the rear of the boat after it has been put in the water and may be folded rearwardly after unlocking by the simple fact of starting up the boat on the water. The devices then may be pulled upwards by means of a handle or a rope arranged in a closed loop for placing the wheel parallel to the inflatable pneumatic float and folded back completely against the back board, the upper part of the wheel being substantially at the upper part of the float, where upon the support is locked in this position.

The operation for opening out the support or bringing it into the operative position especially in a heavy sea for landing is simply achieved after unlocking by means of the same rope pulled in the opposite direction, the device being again locked in the folded out position for use for hauling in, transport on land and placing in the water again.

With the device of the invention, these three operations can be carried out without dismantling or reassembling from outside the boat and comprises no fragile part.

BRIEF DESCRIPTION OF THE DRAWINGS

The invention will be better understood with reference to the accompanying drawings in which:

FIG. 3 shows the support in a side view during folding;

FIG. 4 shows the inside of the fixed part of the support, the mobile part of the support being folded but not locked;

FIG. 5 shows the inside of the fixed part of the support, the mobile part of the support being folded and locked;

FIG. 11 shows a variant concerning the rope used for unfolding;

FIG. 12 shows a variant concerning the device for fastening tube 10;

FIG. 13 shows a variant concerning the form of the base of tubes 5 and 6;

FIGS. 17–19 show variants of the unfolding device.

DETAILED DESCRIPTION OF THE PREFERRED EMBODIMENTS

Figure 1:
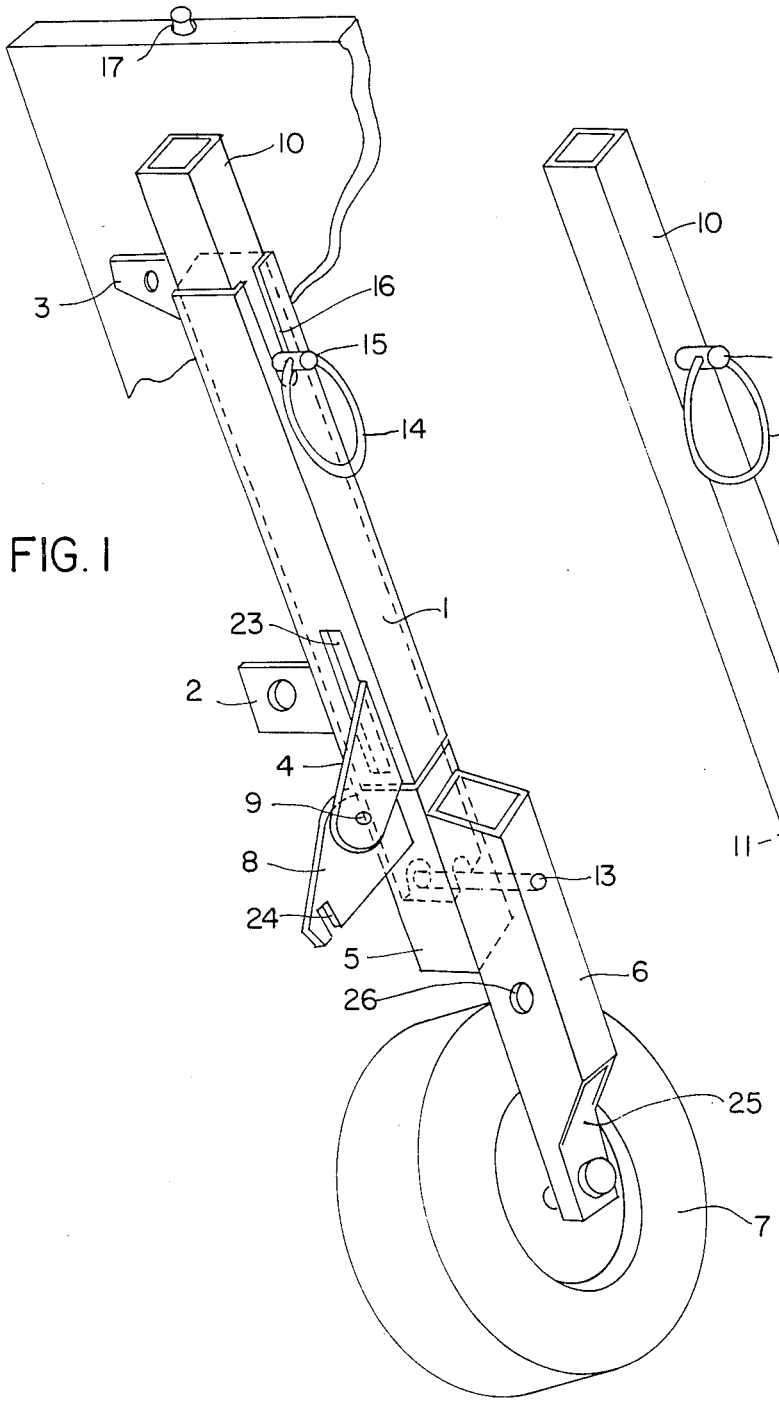
FIG. 1 is a perspective view of one of the supports, fixed on the left hand side of the back board and folded out in operative position.

Such as it is shown in FIG. 1, the device comprises a metal tube of square section 1 fixed to the boat by the bracket 2 which also serves as lateral guide for unfolding and by bracket 3, these two brackets being adapted to the configuration of the boat.

Tube 1 is provided at its lower end with a longitudinally fixed fin 4, its flat face being perpendicular to the front face of this tube.

A second metal tube of the same square section 5 is extended by a third square tube 6, recessed and reinforced at its lower part 25 supporting the wheel 7, tubes 5 and 6 forming an integral assembly.

Tube 5 comprises at its upper part a fin 8 offset with respect to fin 4 and fixed longitudinally, its flat face being perpendicular to the front face and in the form of a hook.

Fin 8 is hinged to tube 1 by means of a removable bolt 9 passing through the two fins 4 and 8, the assembly of tubes 5 and 6 being able to be raised upwardly or diassembled for replacement by other assemblies of different dimensions, adapted to the characteristics of the different motors and the boats.

Figure 2:
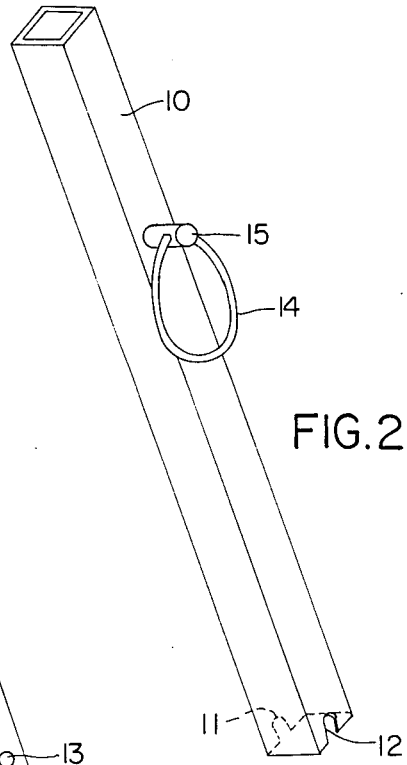
FIG. 2 shows the square tube serving as bolt and sliding inside the support of FIG. 1 for making the device fold or for maintaining it rigid.

A metal tube 10 of smaller square section (FIG. 2) may slide upwardly and downwardly inside tubes 1 and 5. Tube 10 has at its lower end two notches 11, 12 which fit onto pin 13, as seen in FIG. 1, this latter extending through tubes 5 and 6 to which it is secured for immobilizing these tubes in this position.

Tubes 1 and 5 are held locked and in the extension with one another, when the wheel is in the operative position.

Tube 10 is drawn upwardly by using a rope loop 14 fitted into the swivel 15 fixed to tube 10, this swivel moves inside a slot 16 disposed at the upper part of tube 1.

Loop 14 is secured to a swivel 17 fixed to the boat, and in this position the wheel-carrying tubes 5 and 6 may be raised upwards, particularly by the simple fact of starting up the boat on the water followed by Archimides thrust (i.e., buoyancy) on the wheel.

A cord 18, shown in FIG. 3, arranged as a closed loop passing over a pulley 19, slides into tubes 6 through hole 26 and through guides 20 and 21 respectively on tubes 1 and 5. The loop has a stop or a knot 22 for completely raising the wheel by pulling this cord in the required direction.

Figure 6:
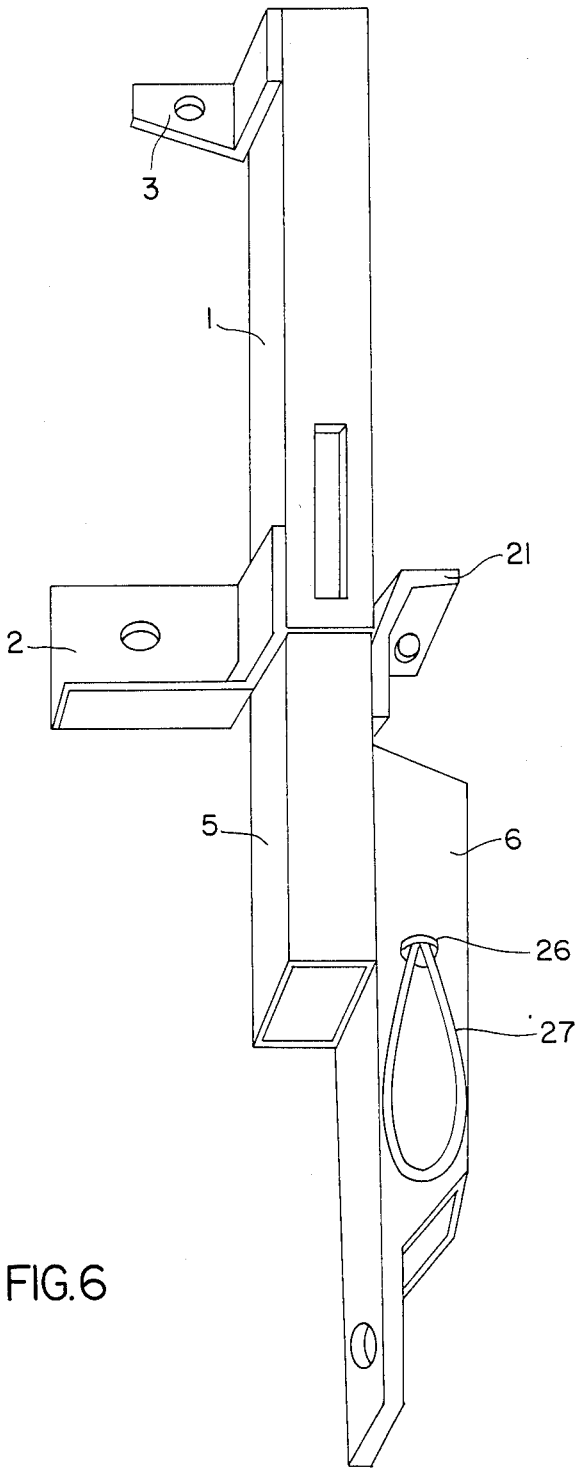
FIG. 6 shows the unfolded support with its lateral guides and the rope handle forming a second folding process.

Folding up may also be provided by means of a cord handle 27, as seen in FIG. 6, replacing the cord 18. The handle is engaged in hole 26 of tube 10, which handle is pulled from the boat. As seen in FIG. 4, a mortice 23 in the tube 1 allows fin 8 to penetrate into the same tube.

Disengagement of loop 14 secured to tube 10 causes this tube to descend by gravity and to be engaged with its edge in hook 24 of fin 8, seen in FIG. 5. The support and wheel assembly are then fixed in the high position. By pulling loop 14 upwards and fastening it, tube 10 can be raised and hook 24 freed. The hole assembly falls back again by gravity and partially unfolds, the wheel floating on the water. Pulling on cord 18 as seen in FIG. 3, in the direction opposite the preceding direction, causes action of stop 22 on guide 21, and action of the lever whose arm is situated from the guide 21 to the pin or bolt 9. This causes penetration of the wheel into the water by force exceeding the buoyancy of the wheel. The correct positioning of tubes 1 and 5 as an extension of each other is provided by the action of bracket 2 and guide 21 (seen in FIG. 6), further used as lateral positioners. Referring to FIG. 1, disengagement of the loop 14 from tube 10 allows this tube to descend by gravity into tubes 1 and 5 and to be fitted onto the pin 13. The support is then in position for use.

Figures 7, 8, 9, 10:
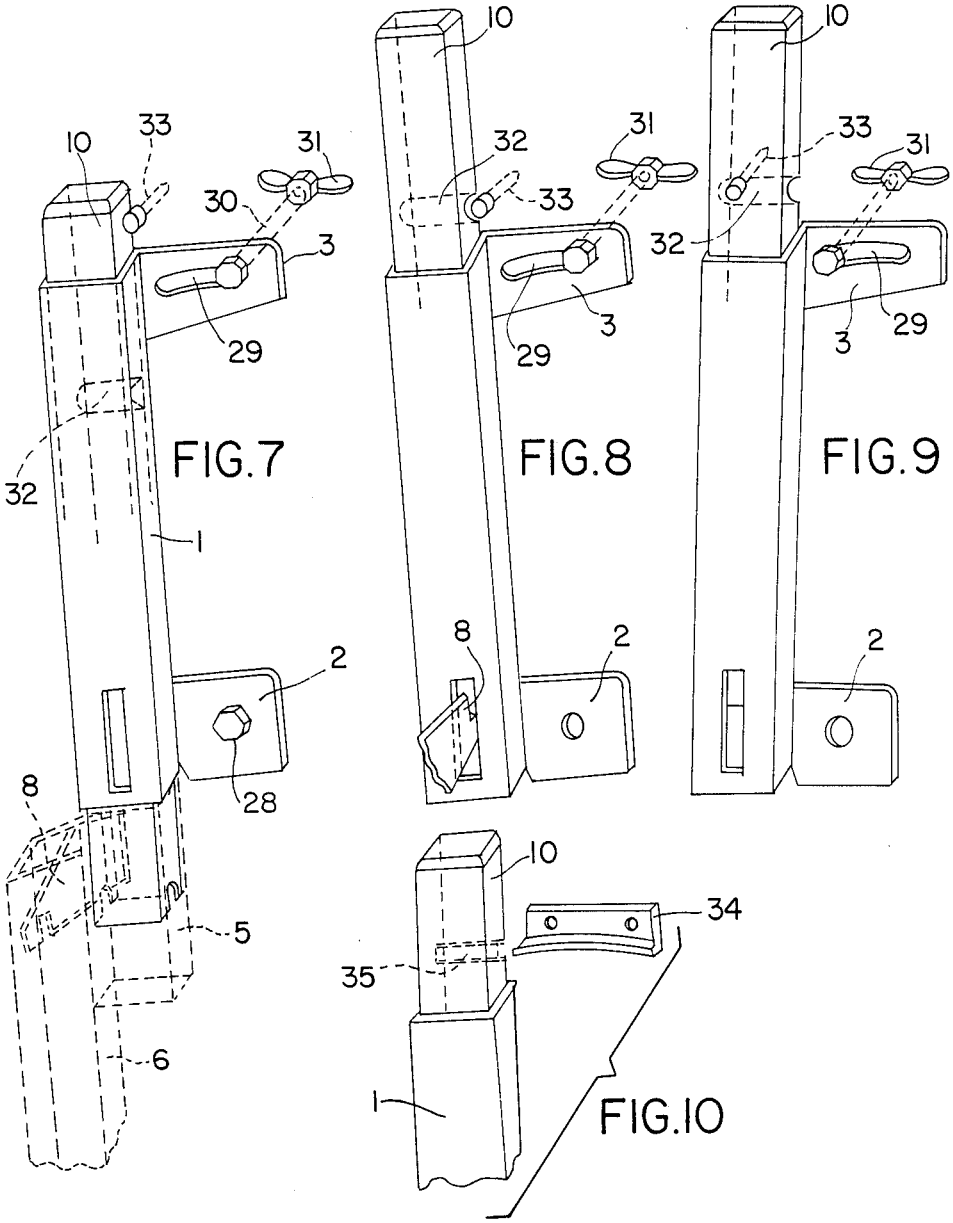
FIGS. 7, 8 and 9 show a variant concerning the slope of the support.
FIG. 10 shows a notch and locking system variant.

Referring to FIGS. 7, 8 and 9, an alternative embodiment of the device concerns an additional safety adaptation means for the support in the case where large motors are used in which the length of the propeller shaft may hinder its operation in the accidental case of maximum and simultaneous steering lock of the motor during the folding and unfolding operation. Tube 10 holds the wheel in position at extremes of the folding and unfolding operation.

The upper part of the support is fixed to the back board of the boat and its fastenings are adapted to the back board characteristics. Alternative embodiments of FIGS. 7–10 and 12 include means for slanting the support with respect to the board such that its foldable and unfoldable part does not risk touching the propeller shaft or the propeller during the folding operation and then replacing the folded support and its wheel against the inner side of the float. In this case, tube 5 or tube 6 is extended as far as the shaft of the wheel may allow one or the other way and still ensure support of the wheel 7.

FIG. 7 shows the right hand support seen from the rear of the boat sloping leftwards while pivoting about the removable fixing pin 28 of bracket 2 of tube 1, the assembly of tubes 5 and 6 supporting the wheel being considered as being unfolded and locked.

The tube 1 is in each case fixed to the boat with adapted brackets 2 and 3.

Bracket 3 is provided with a mortice 29 in which slides the removable bolt 30 passing through the back board, the bolt being able to be tightened and untightened from inside the boat with its wing nut 31.

Tube 10 is inserted in tube 1 in the locking position, this tube having on its rear face a notch 32 in its cross direction.

The swivel pin 33 fixed to the back board forming a stop and maintaining the tube 10 and the assembly of the support unfolded in this sloping position in the case of accidental slackening of the wing nut 31.

FIG. 8 shows the support in the folded and locked position. Hook 8 of the foldable and unfoldable part maintained in position by tube 10 which was pulled to allow folding and reinserted for locking, the swivel 33 being opposite the notch 32.

FIG. 9 shows the support placed again in the vertical position after untightening and retightening of the wing nut 31, the swivel 33 engaged in notch 32 preventing any unlocking and unfolding without further movement of the support leftwards in the safety position.

FIG. 10 shows a variant of the square section notch 35 in tube 10 and the locking system 34 replacing the swivel 33 and allowing a greater sloping latitude.

FIG. 11 such as it is shown concerns the variant of a more efficient means for overcoming Archimedes thrust (i.e., buoyancy) and immersing the wheel for bringing it into service. FIG. 11 shows the support during unfolding, the segment of rope 18, this latter having its stop or knot 22 acting on guide 21 forming a stop through the pulley 19 and guide 20 and being provided with a handle 36 for facilitating the required pull on said cord and immersing the wheel 7.

FIG. 12 shows the variant of a fastening means which is better placed and more convenient for the rope loop 14 integral with tube 10 for unlocking the relocking the support.

Tube 1 may be fixed, for example, to the back board with the bracket 3, the tube 10 being able to be pulled entirely with its rope loop 14 or fastened to the swivel pin 37 in the form of a pulley fixed to the internal face of the back board of the boat.

FIG. 13 shows a variant including means for avoiding the disadvantages due to the projection under the lower part of the boat of elements of the support, which collect water when travelling at high speeds. FIG. 13 shows the base of the support completely folded and unlocked.

Tube 1 is again fixed to the back board of the boat, the hook 8 forming the hinge of the assembly of tubes 5 and 6, and as shown in FIG. 11, carrying the wheel 7.

The base of tubes 5 and 1 are shaped at an angle and inclined in a direction for avoiding collecting water without adversely affecting their adjustment when, the support is unfolded.

Figure 14:
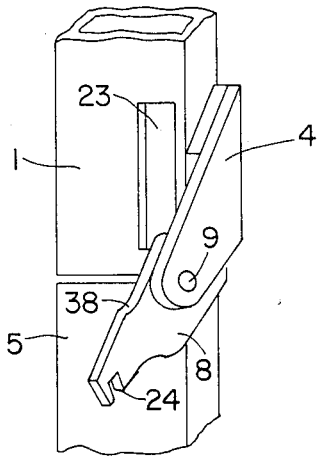
FIG. 14 shows a variant concerning the hinging of the device.

FIG. 14 shows a variant of a more practical means for fixing the fin 4 on tube 1 and fin 8 on tube 5. FIG. 14 shows the hinge of the right hand support seen from the front i.e. from the rear of the boat.

Fin 4 is fixed flat on the right hand side of tube 1, its flat face offset and parallel to the right hand side of said tube.

Fin 8 is fixed flat on the right hand side of the tube 5, its flat face parallel to the right hand side of the tube 5, the part of this fin forming a hook offset leftwards by a bend 38.

The mortice 23 on the front face of tube 1 is offset rightwards so as to correspond to the penetration of fin 8 and of its hook.

Figure 15:
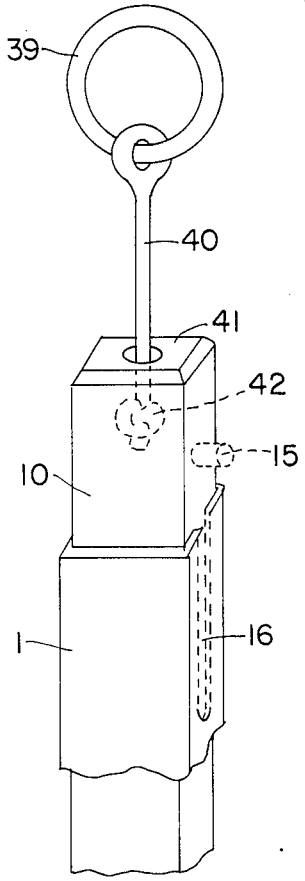
FIGS. 15 and 16 show a variant concerning the locking and unlocking device.

FIG. 15 shows a variant concerning a simplification of the formation of tube 1 by omitting the slit 16.

Thus, the device operates by pulling tube 10 completely out of tube 6 if required for unlocking and inserting it again in this tube for locking.

Tube 10 can be removed from tube 1 by pulling its loop 39 and attached rope 40 passes through the plug 41 integral with tube 10 and is provided with a stop or knot 42.

Figure 16:
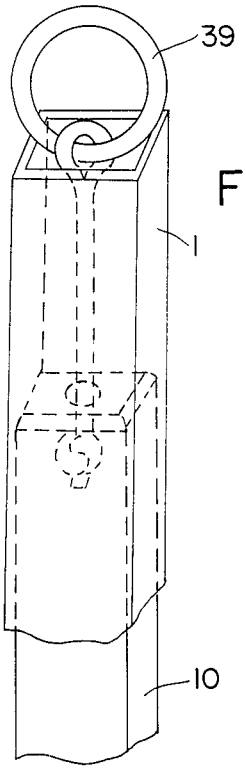

For locking, tube 10 without swivel 15 is reinserted in tube 1, the loop 39 preventing tube 10 from dropping in the case of a false maneuver (FIG. 16).

FIGS. 17 and 18 show a device formed by a lever for causing the wheel to penetrate more readily in the water during unfolding.

This device is formed by a tube 43 having indentations 44, 45 at its ends, fixed to the side of the upper part of the tube 1 on the same side as the pulley by means of a pin 46 integral with tube 1 and passing through the upper part of tube 43 adjacent tube 1.

Tube 43 is able to pivot about this axis parallel to the side of tube 1 so that its other end 45 may be below, along side or above this pin.

The end of tube 43 opposite the one pivoting on pin 46 is provided with a hole 47 used for fixing the rope 18 passing over pulley 19 and fixed to tube 5 by the guide bracket 21.

A rod 49 of a length greater than tube 43 and able to slide inside this tube 43 is held in place by a pin 48 at its upper end and by a ball used as a handle 50 at its lower end.

After unlocking in a first stage of unfolding the wheel floats on the water, whereupon rope 18 is stretched.

Inasmuch as the wheel is connected to the lever formed by tube 43 and rod 49 and stretches the rope 18, the lever is at that time substantially vertical.

The user's pulling the lever finishes the unfolding and penetration of the wheel 7 into the water without excessive effort;

The rope 18 is stretched, the support completely unfolded.

When the lever is raised vertically above pin 46, rod 49 drops under the action of its weight and slides downwards in tube 43 parallel to the side of tube 1 and of the back board of the boat.

The lower end of the rod 49 bears on the back board and holds the assembly of the lever locked in this position.

By pulling upwards on rod 49, with its handle 50, the lever may be again swung downwards for folding and locking the support.

Figure 19:
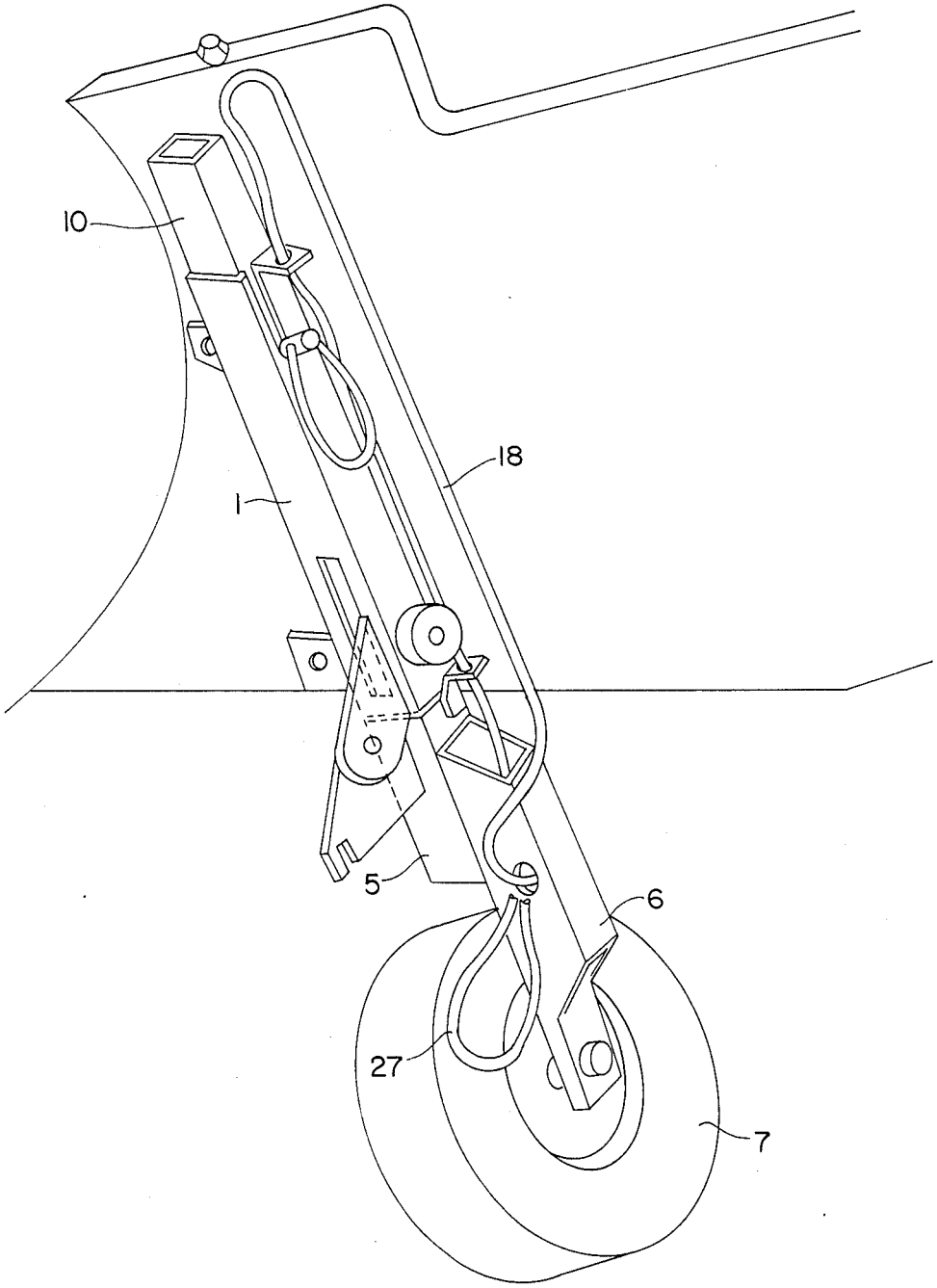

FIG. 19 is a further embodiment showing a different arrangement of guiding rope 18 through tube 6.

The wheel support of the invention may remain permanently on the boat and requires no assembly, nor disassembly for putting it into the water from the shore, for sailing and for hauling the boat in again.

It avoids storing the wheels in the boat or having them projecting above the boat during sailing.

It allows the wheels to be brought readily into service, more particularly in a rough sea, for landing directly and for protecting the propeller of the motor in shallow water.

It is simple, robust and comprises no fragile part.

I claim:

1. A retractable wheel support adapted to be mounted on a chassis, comprising:

a first tube adapted to be fixed along said chassis, the first tube having a proximal end and a distal end, the first tube having an aperture at the distal end;

a second tube movably mounted with respect to the first tube such that the first and second tubes are alignable at the distal end, the first and second tubes having corresponding internal cross-sections;

an assembly of two fins, one of the fins extending from a wall of the first tube at said distal end adjacent a cut-out in said wall of the first tube, a second of the fins extending from a wall of the second tube, the two fins being pivotally connected and the second fin having a notched end that extends into the cut-out when the first and second tubes are pivoted toward one another, out of alignment;

a further tube dimensioned to slide inside the first and second tubes through said aperture, a proximal end of said further tube having a manually-engagable member for raising the further tube from the second tube to allow pivoting of the first and second tubes, and a distal end of said further tube being adapted for cooperating with the notched end of the second fin when the first and second tubes are folded, the further tube being thereby adapted for locking the first and second tubes in aligned position and in folded position;

at least one pulling member for controlling pivoting of the first and second tubes; and a wheel mounted with respect to said second tube.

2. The support of claim 1, wherein the wheel is mounted to the second tube by a further tube attached laterally to said second tube, and further comprising a stop extending into the second tube, the stop holding the further tube when the first and second tubes are aligned.

3. The support of claim 1, wherein the pulling member is a looped cord extending along the first, second and further tubes in guides for the cord, the cord having a stop for engaging a guide of the second tube.

4. The support of claim 1, wherein the pulling member is a cord passing along guides on the first and second tubes, the cord having a stop at one end adapted for engaging the guide of the second tube and a handle at an opposite end.

5. The support of claim 1, wherein the first tube is mounted to said chassis by an upper lug, the upper lug having a mortise into which extends a fixing screw extending through the chassis and affixed thereto by a wing nut, and a lower lug affixed to the first tube, the lower lug being connected to the chassis by a bolt forming a pivot shaft, whereby the support is pivotable about said bolt between a vertical position and an inclined position within limits defined by the mortise, the upper lug being fixed and unfixed by tightening and loosening the wing nut, and the further tube and the chassis having complementary locking means, the locking means on the chassis being aligned to engage a locking means on the further tube when the further tube is raised, allowing folding of the support, said locking means preventing unfolding of the support in a vertical position.

6. The support of claim 1, wherein the pulling member has a sleeve pivotally mounted on the first tube and a lever, longer than the sleeve and provided with stops preventing a complete separation of the lever and sleeve, the pulling member further comprising a cord affixed to the lever and to the proximal end of the second tube through a guide member on the first tube, whereby the first and second tubes are pulled into aligned position by operation of the lever.

* * * * *